US010269548B1

(12) United States Patent
Field

(10) Patent No.: US 10,269,548 B1
(45) Date of Patent: Apr. 23, 2019

(54) AUTOMATIC CONTROL OF FLOW RATE FOR SAMPLE INTRODUCTION SYSTEM RESPONSIVE TO SAMPLE INTENSITY

(71) Applicant: Elemental Scientific, Inc., Omaha, NE (US)

(72) Inventor: Michael Paul Field, Papillion, NE (US)

(73) Assignee: Elemental Scientific, Inc., Omaha, NE (US)

( * ) Notice: Subject to any disclaimer, the term of this patent is extended or adjusted under 35 U.S.C. 154(b) by 22 days.

(21) Appl. No.: 15/596,105

(22) Filed: May 16, 2017

Related U.S. Application Data

(60) Provisional application No. 62/337,063, filed on May 16, 2016.

(51) Int. Cl.
*H01J 49/04* (2006.01)
*H01J 49/10* (2006.01)

(52) U.S. Cl.
CPC ..... *H01J 49/04* (2013.01); *H01J 49/105* (2013.01)

(58) Field of Classification Search
CPC ..... H01J 49/04; H01J 49/105
USPC ..... 250/288, 281, 282, 283
See application file for complete search history.

(56) References Cited

U.S. PATENT DOCUMENTS 8,925,375 B1 1/2015 Wiederin
2011/0253224 A1* 10/2011 Linder ..... B01L 3/5027 137/2

* cited by examiner

*Primary Examiner* — Nicole M Ippolito
(74) *Attorney, Agent, or Firm* — Kevin E. West; Advent, LLP

(57) ABSTRACT

A system embodiment includes, but is not limited to, a syringe pump operably coupled to a desolvation unit, the desolvation unit coupled to a sample analyzer configured to measure an intensity of one or more analytes in a sample solution provided through operation of the syringe pump; and a controller operably coupled to the syringe pump, the controller configured to receive the intensity of the one or more analytes measured by the sample analyzer, determine whether the intensity exceeds a threshold difference of an intensity of at least one standard measured by the sample analyzer, and adjust one or more control parameters of the syringe pump when the intensity of the one or more analytes exceeds the threshold difference to control a flow rate of the sample solution introduced to the sample analyzer.

17 Claims, 3 Drawing Sheets

AUTOMATIC CONTROL OF FLOW RATE FOR SAMPLE INTRODUCTION SYSTEM RESPONSIVE TO SAMPLE INTENSITY

CROSS-REFERENCE TO RELATED APPLICATIONS

The present application claims the benefit under 35 U.S.C. § 119(e) of U.S. Provisional Application Ser. No. 62/337,063, filed May 16, 2016, and titled "AUTOMATIC CONTROL OF FLOW RATE FOR SAMPLE INTRODUCTION SYSTEM RESPONSIVE TO SAMPLE INTENSITY." U.S. Provisional Application Ser. No. 62/337,063 is herein incorporated by reference in its entirety.

BACKGROUND

Spectrometry refers to the measurement of radiation intensity as a function of wavelength to identify component parts of materials. Inductively Coupled Plasma (ICP) spectrometry is an analysis technique commonly used for the determination of trace element concentrations and isotope ratios in liquid samples. For example, in the semiconductor industry, ICP spectrometry can be used to determine metal concentrations in samples. ICP spectrometry employs electromagnetically generated partially ionized argon plasma which reaches a temperature of approximately 7,000K. When a sample is introduced to the plasma, the high temperature causes sample atoms to become ionized or emit light. Since each chemical element produces a characteristic mass or emission spectrum, measuring the spectra of the emitted mass or light allows the determination of the elemental composition of the original sample. The sample to be analyzed is often provided in a sample mixture.

Sample introduction systems may be employed to introduce liquid samples into the ICP spectrometry instrumentation (e.g., an Inductively Coupled Plasma Mass Spectrometer (ICP/ICP-MS), an Inductively Coupled Plasma Atomic Emission Spectrometer (ICP-AES), or the like) for analysis. For example, a sample introduction system may withdraw an aliquot of a liquid sample from a container and thereafter transport the aliquot to a nebulizer that converts the aliquot into a polydisperse aerosol suitable for ionization in plasma by the ICP spectrometry instrumentation. The aerosol is then sorted in a spray chamber to remove the larger aerosol particles. Upon leaving the spray chamber, the aerosol is introduced into the plasma by a plasma torch assembly of the ICP-MS or ICP-AES instruments for analysis.

SUMMARY

Systems and methods for automatic control of a flow rate of a sample introduction system are described, where the flow rate (e.g., sample flow, carrier flow, sample/carrier mixture flow) is automatically controlled responsive to a sample intensity measured by a sample analysis system (e.g., ICP-MS, ICP-AES, etc.). A system embodiment includes, but is not limited to, a syringe pump operably coupled to a desolvation unit, the desolvation unit coupled to a sample analyzer configured to measure an intensity of one or more analytes in a sample solution provided through operation of the syringe pump; and a controller operably coupled to the syringe pump, the controller configured to receive the intensity of the one or more analytes measured by the sample analyzer, determine whether the intensity exceeds a threshold difference of an intensity of at least one standard measured by the sample analyzer, and adjust one or more control parameters of the syringe pump when the intensity of the one or more analytes exceeds the threshold difference to control a flow rate of the sample solution introduced to the sample analyzer.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DRAWINGS

The detailed description is described with reference to the accompanying figures. In the figures, the use of the same reference numbers in different instances in the description and the figures may indicate similar or identical items.

DETAILED DESCRIPTION

Figure 1:
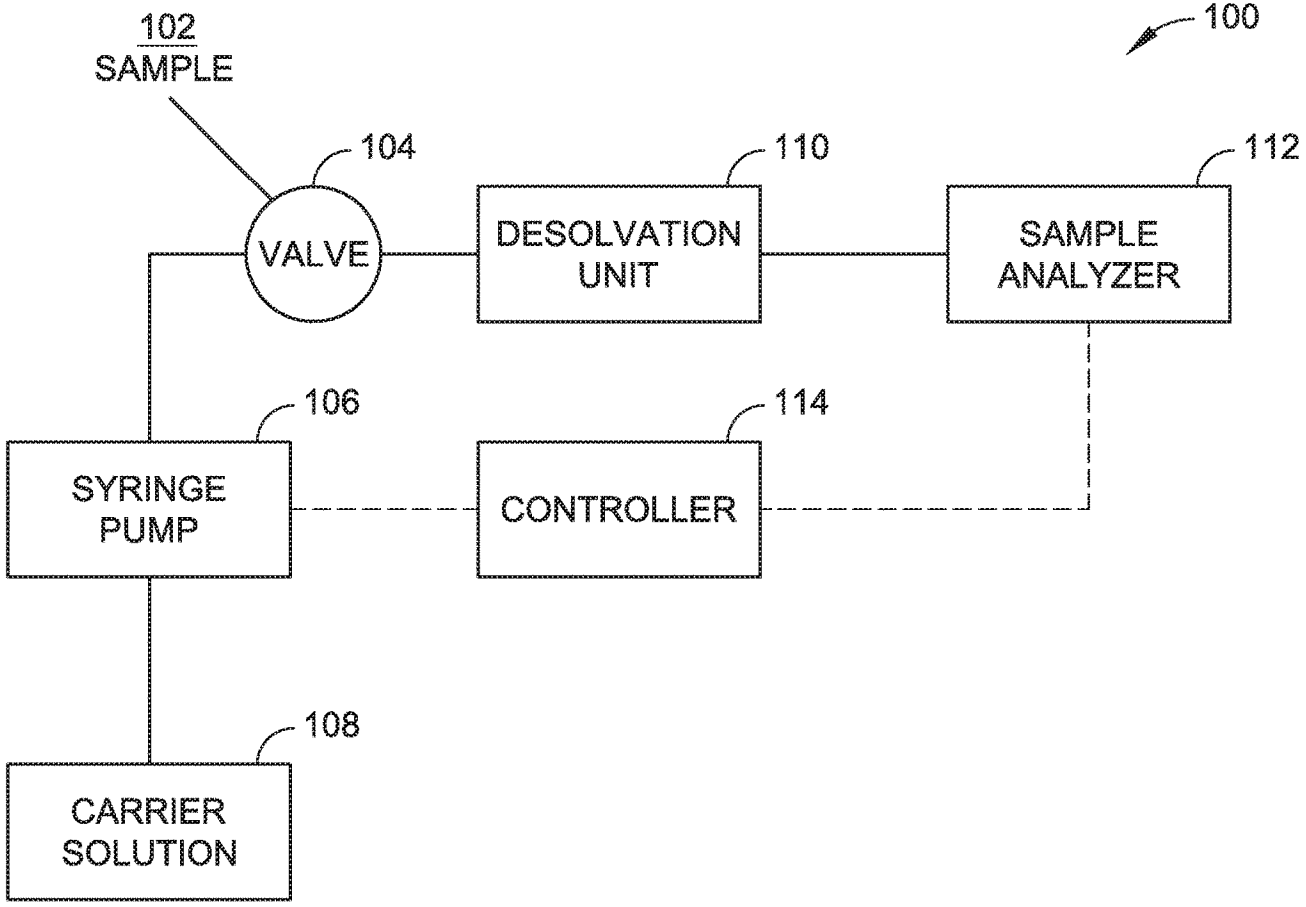
FIG. 1 is a schematic illustration of a system for automatic control of flow rate for a sample introduction system responsive to sample intensity in accordance with example implementations of the present disclosure.
Figure 2:
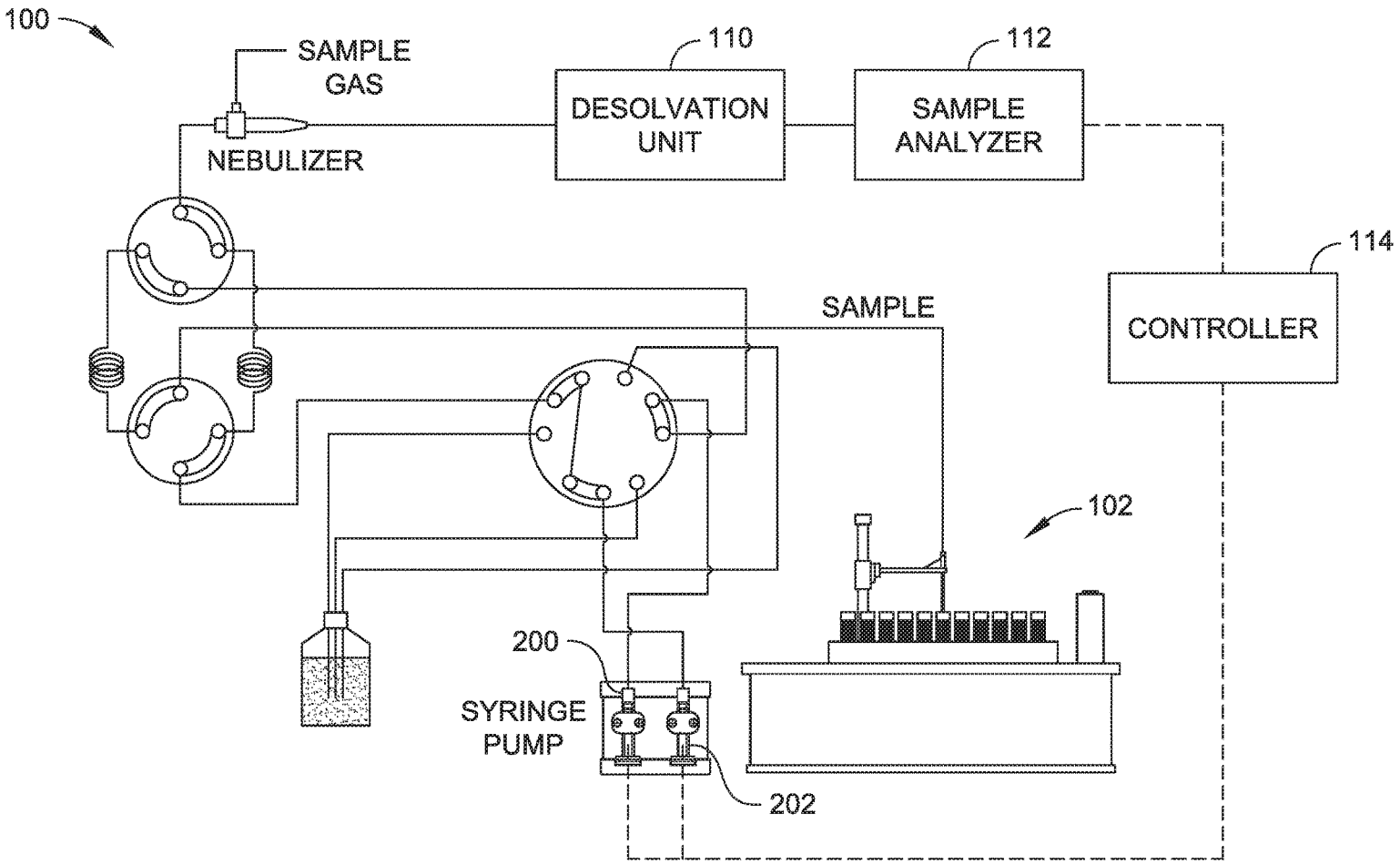
FIG. 2 is a schematic illustration of a system for automatic control of flow rate for a sample introduction system responsive to sample intensity in accordance with example implementations of the present disclosure.

Referring to FIGS. 1 and 2, automatic control of a flow rate of a sample introduction system is described. The flow rate of a sample, a carrier, a sample/carrier mixture, or other flow is automatically controlled responsive to a sample intensity measured by a sample analysis system (e.g., ICP-MS, ICP-AES, etc.). The system can include a desolvation unit to remove solvent from the sample prior to introduction of the sample to an injector for analysis by a sample analysis system. Desolvation units can include one or more of Peltier desolvation and membrane desolvation to facilitate the influence of polyatomic ion interferences during the analysis of the sample. For example, polyatomic ion interferences, such as oxides, hydrides and others, may form when oxygen or hydrogen derived from water or other solvents combine with species present in the sample. In many cases these interferences limit the accuracy or precision of analytic determinations by the sample analysis system.

In general, when multiple samples, standards, or combinations of samples and standards are analyzed via ICP-MS or ICP-AES, the accuracy of the quantitative analysis is improved when the measured intensities of the samples or standards are substantially similar to each other. When the intensities of the samples or standards become more distinct (e.g., greater than a 10% difference in intensity between samples or standards), the isotopic ratios measured by MC-ICP-MS (Multicollector Inductively Coupled Plasma Mass Spectrometer) can begin to lose accuracy or become unreliable. The error associated with intensity differences can be mitigated by diluting all samples to the same concentration after first analyzing the sample intensity, however such dilution can lead to waste of the sample and/or diluent. Furthermore, manually diluting samples requires a minimum of two analyses to be performed on each sample: one to first determine the intensity and dilution factor required, and a second after the dilution to acquire accurate and precise data.

Accordingly, the present disclosure is directed to systems and methods for automatic control of a flow rate of a sample introduction system, where the flow rate (e.g., sample flow, carrier flow, sample/carrier mixture flow) is automatically controlled responsive to a sample intensity measured by a sample analysis system (e.g., MC-ICP-MS, ICP-MS, ICP-AES, etc.). For desolvation systems having flow rates up to about 300 microliters per min (300 μL/min), the intensity of a sample and the flow rate of the sample have an approximately linear relationship. Thus, if a sample has an intensity measured by the sample analysis system that differs more than about 10% of a standard intensity, a controller can adjust control parameters of a pump (e.g., a syringe pump) to increase or decrease the flow rate of the sample to provide a sample intensity that is the same as the standard intensity.

EXAMPLE IMPLEMENTATIONS

Referring generally to FIGS. 1 and 2, systems are shown to provide automatic control of a flow rate of a sample introduction system responsive to an intensity of a sample analyzed by a sample analysis system. In an implementation, shown in FIG. 1, a system 100 includes a sample 102, a valve 104, a syringe pump 106, a carrier solution 108, a desolvation unit 110, a sample analyzer 112, and a controller 114. The sample 102 can be provided to the valve 104 via an autosampler unit, a sample pump, or the like. The valve 104 is coupled to the sample 102, the syringe pump 106, and the desolvation unit 110 to receive the carrier solution 108 and the sample 102 and to pass them, either independently or in combination (e.g., as a sample/carrier solution), to the desolvation unit 110. While a single valve 104 is shown in FIG. 1, the valve 104 can be part of a valve system comprised of multiple valves, including but not limited to multi-port valves to facilitate transfer of fluids throughout the system 100. The desolvation unit 110 is coupled to the sample analyzer 112 to direct the desolvated sample for analysis. The sample analyzer 112 can include, but is not limited to an ICP-MS system (e.g., MC-ICP-MS system) or an ICP-AES system. The sample is quantitatively analyzed by the sample analyzer 112 to provide an intensity of the sample. The controller 114 is operably coupled to the sample analyzer 112 to receive the measured intensity and to automatically adjust control parameters of the syringe pump 106 to control the flow rate of fluid introduced to the sample analyzer 112. For example, in an implementation, the controller 114 can determine whether the sample intensity of a measured by the sample analyzer 112 exceeds a threshold difference (e.g., a 10% difference) in intensity as compared to an intensity of a standard solution analyzed by the sample analyzer 112. When the controller 114 determines that the measured sample intensity exceeds the threshold difference, the controller 114 can adjust the control parameters of the syringe pump 106 to increase or decrease the flow rate of the fluid introduced to the sample analyzer 112. For example, when the measured sample intensity exceeds the threshold difference by being substantially higher (e.g., at least 10% higher) than the intensity of the standard solution, then the controller 114 can adjust the control parameters of the syringe pump 106 to decrease the flow rate of the fluid introduced to the sample analyzer 112 to reduce the intensity of the sample. When the measured sample intensity exceeds the threshold difference by being substantially lower (e.g., at least 10% lower) than the intensity of the standard solution, then the controller 114 can adjust the control parameters of the syringe pump 106 to increase the flow rate of the fluid introduced to the sample analyzer 112 to increase the intensity of the sample. In implementations, the flow rate of the fluid introduced to sample analyzer 112 is maintained below about 300 microliters per min (300 μL/min), such as to maintain an approximately linear relationship between flow rate and intensity.

While the system 100 provided in FIG. 1 shows one syringe pump (pump 106), the controller 114 can be configured to operate with a plurality of pumps, or for systems having multiple sample loops particularly for high throughput fluid flow systems (e.g., a system with multiple sample loops with alternating dispensing and rinsing/cleaning cycles, such as provided in U.S. Pat. No. 8,925,375, incorporated herein by reference in its entirety). For example, referring to FIG. 2, the system 100 can include a plurality of syringe pumps (syringe pump 200 and syringe pump 202 are shown), whereby the controller 114 can independently adjust the control parameters of each syringe pump to provide a flow rate of sample to the sample analyzer 112 configured to provide an intensity that is substantially similar to the intensity of standards or other samples.

The systems described herein can include a computing device including a processor and a memory. The processor provides processing functionality for the computing device and may include any number of processors, micro-controllers, or other processing systems, and resident or external memory for storing data and other information accessed or generated by the computing device. The processor may execute one or more software programs that implement the techniques and modules described herein. The processor is not limited by the materials from which it is formed or the processing mechanisms employed therein and, as such, may be implemented via semiconductor(s) and/or transistors (e.g., electronic integrated circuits (ICs)), and so forth.

The memory is an example of device-readable storage media that provides storage functionality to store various data associated with the operation of the computing device, such as the software program and code segments mentioned above, or other data to instruct the processor and other elements of the computing device to perform the techniques described herein. Although a single memory is mentioned above, a wide variety of types and combinations of memory may be employed. The memory may be integral with the processor, stand-alone memory, or a combination of both. The memory may include, for example, removable and non-removable memory elements such as RAM, ROM, Flash (e.g., SD Card, mini-SD card, micro-SD Card), magnetic, optical, USB memory devices, and so forth. In embodiments of the computing device, the memory may include removable ICC (Integrated Circuit Card) memory such as provided by SIM (Subscriber Identity Module) cards, USIM (Universal Subscriber Identity Module) cards, UICC (Universal Integrated Circuit Cards), and so on.

The computing device includes a display to display information to a user of the computing device. In embodiments, the display may comprise a CRT (Cathode Ray Tube) display, an LED (Light Emitting Diode) display, an OLED (Organic LED) display, an LCD (Liquid Crystal Diode) display, a TFT (Thin Film Transistor) LCD display, an LEP (Light Emitting Polymer) or PLED (Polymer Light Emitting Diode) display, and so forth, configured to display text and/or graphical information such as a graphical user interface. The display may be backlit via a backlight such that it may be viewed in the dark or other low-light environments.

The display may be provided with a touch screen to receive input (e.g., data, commands, etc.) from a user. For example, a user may operate the computing device by touching the touch screen and/or by performing gestures on the touch screen. In some embodiments, the touch screen may be a capacitive touch screen, a resistive touch screen, an infrared touch screen, combinations thereof, and the like. The computing device may further include one or more input/output (I/O) devices (e.g., a keypad, buttons, a wireless input device, a thumbwheel input device, a trackstick input device, and so on). The I/O devices may include one or more audio I/O devices, such as a microphone, speakers, and so on.

The computing device may also include a communication module representative of communication functionality to permit computing device to send/receive data between different devices (e.g., components/peripherals) and/or over one or more networks. Communication module may be representative of a variety of communication components and functionality including, but not necessarily limited to: a browser; a transmitter and/or receiver; data ports; software interfaces and drivers; networking interfaces; data processing components; and so forth.

The one or more networks are representative of a variety of different communication pathways and network connections which may be employed, individually or in combinations, to communicate among the components of the system 100. Thus, the one or more networks may be representative of communication pathways achieved using a single network or multiple networks. Further, the one or more networks are representative of a variety of different types of networks and connections that are contemplated including, but not necessarily limited to: the Internet; an intranet; a Personal Area Network (PAN); a Local Area Network (LAN) (e.g., Ethernet); a Wide Area Network (WAN); a satellite network; a cellular network; a mobile data network; wired and/or wireless connections; and so forth.

Examples of wireless networks include, but are not necessarily limited to: networks configured for communications according to: one or more standard of the Institute of Electrical and Electronics Engineers (IEEE), such as 802.11 or 802.16 (Wi-Max) standards; Wi-Fi standards promulgated by the Wi-Fi Alliance; Bluetooth standards promulgated by the Bluetooth Special Interest Group; and so on. Wired communications are also contemplated such as through Universal Serial Bus (USB), Ethernet, serial connections, and so forth.

The computing device is described as including a user interface, which is storable in memory and executable by the processor. The user interface is representative of functionality to control the display of information and data to the user of the computing device via the display. In some implementations, the display may not be integrated into the computing device and may instead be connected externally using universal serial bus (USB), Ethernet, serial connections, and so forth. The user interface may provide functionality to allow the user to interact with one or more applications of the computing device by providing inputs (e.g., standard concentrations, standard intensities, sample flow rates, etc.) via the touch screen and/or the I/O devices. For example, the user interface may cause an application programming interface (API) to be generated to expose functionality to a flow rate control module to configure the application for display by the display or in combination with another display.

The flow rate control module may comprise software, which is storable in memory and executable by the processor, to perform a specific operation or group of operations to furnish functionality to the computing device. The flow rate control module provides functionality to control the flow rate of, for example, the sample 102 and/or the carrier solution 108 to the desolvation unit 110 and ultimately to the sample analyzer 112.

In implementations, the user interface may include a browser (e.g., for implementing functionality of the control modules described herein). The browser enables the computing device to display and interact with content such as a webpage within the World Wide Web, a webpage provided by a web server in a private network, and so forth. The browser may be configured in a variety of ways. For example, the browser may be configured as a flow rate control module by the user interface. The browser may be a web browser suitable for use by a full resource device with substantial memory and processor resources (e.g., a smart phone, a personal digital assistant (PDA), etc.).

Figure 3:
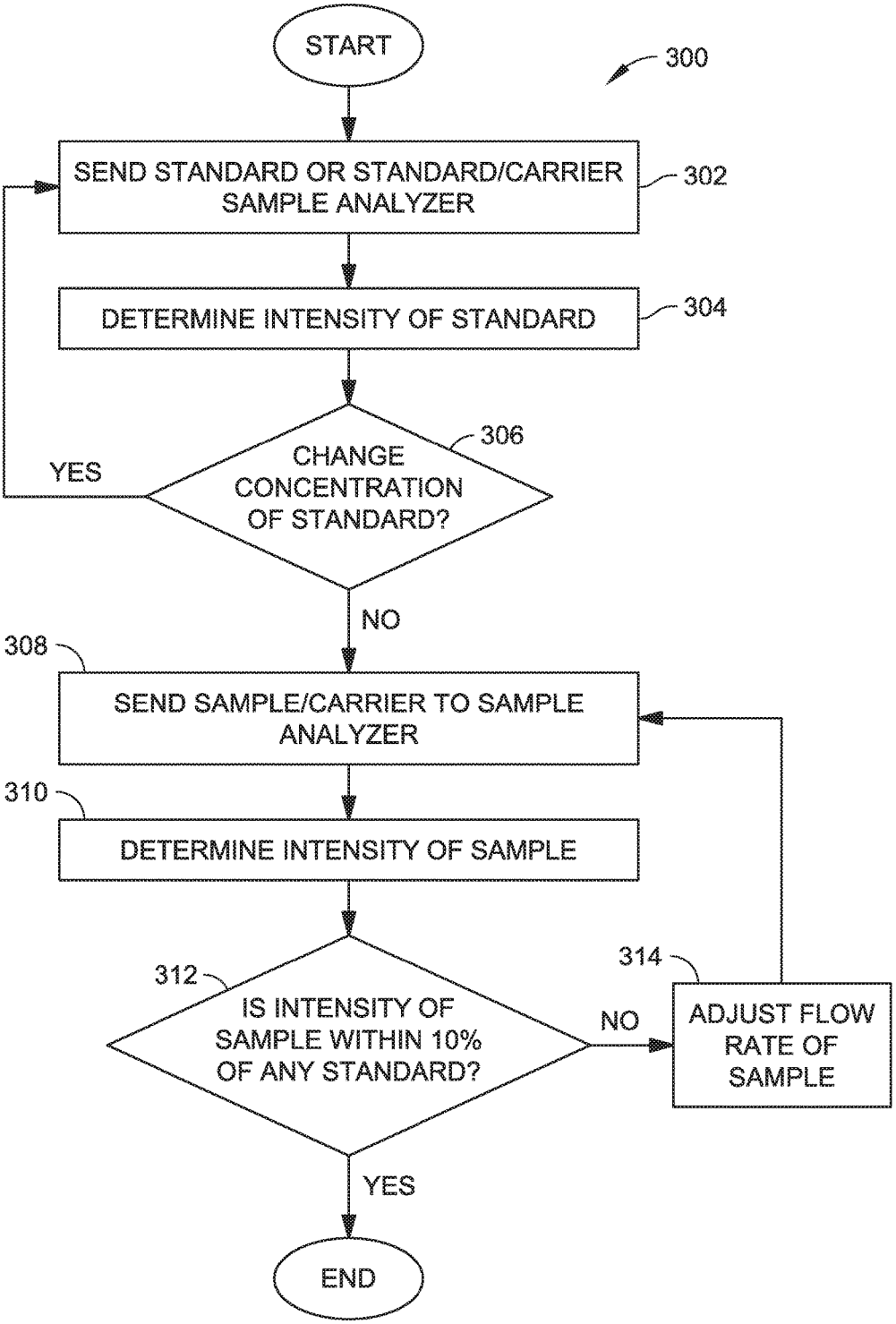
FIG. 3 is a flow diagram of a method for automatically controlling a flow rate of a sample introduction system responsive to sample intensity in accordance with example implementations of the present disclosure.

Referring to FIG. 3, a flow diagram of a method 300 for automatically controlling a flow rate of a sample introduction system responsive to sample intensity is shown in accordance with example implementations of the present disclosure. For example, the method 300 can be facilitated through operation of the controller 114 of the system 100 to control the flow rate of sample (e.g., through control of a flow of carrier fluid) provided to the sample analyzer 112. The method 300 includes sending a standard solution or a standard and carrier solution to a sample analyzer in block 302. For example, the controller 114 can operate one or more syringe pumps (e.g., syringe pump 200, syringe pump 202, and/or other syringe pump(s)) to send a standard solution to the sample analyzer 112, such as by pumping the standard solution directly to the sample analyzer 112 or by using a carrier solution to transport the standard to the sample analyzer. The method 300 also includes determining the intensity of the standard in block 304. For example, the sample analyzer 112 can receive the standard following desolvation by the desolvation unit 110 and measure the intensity of the various analytes contained within the standard. The method 300 also includes determining whether to change the concentration of the standard solution in block 306. For example, the system 100 can build a standard calibration curve based on a plurality of standard concentrations to facilitate measurement of the sample analyte concentrations. In implementations, the controller 114 accesses a standard calibration curve protocol to determine how many standard concentrations are desired to build the standard calibration curve for a particular analyte of interest, the dilution factors desired, and the like. For example, the controller 114 can access the standard calibration curve protocol stored in memory to determine whether additional standard dilutions should be provided to the sample analyzer to build the standard calibration curve. If additional standard concentrations are desired to build the standard calibration curve ("Yes" at decision block 306), then the controller 114 can direct the syringe pumps controlling flow of the standard and the diluent to prepare a desired standard concentration and send the concentration to the sample analyzer 112 (e.g., as provided in block 302). If no additional standard concentrations are desired to build the standard calibration curve ("No" at decision block 306), then the method 300 proceeds to block 308, where the sample is sent to the sample analyzer for analysis. For example, the controller 114 can determine that all standard concentrations have been prepared according to the standard calibration curve protocol, whereby the controller 114 manipulates syringe pump 200 and syringe pump 202 to provide the sample solution to the sample analyzer 112. The method 300 includes determining the intensity of the sample in block 310. For example, the sample analyzer 112 can receive the sample (e.g., sample 102) following desolvation by the desolvation unit 110 and measure the intensity of the various analytes contained within the sample.

The method 300 also includes determining whether the sample is within a threshold difference of any of the standard concentrations used to build the standard concentration curve in block 312. In implementations, the threshold difference is a 10% difference in intensity. For example, the controller 114 can compare the intensity of the sample measured by the sample analyzer 112 in block 310 to the intensity of the various standards measured by the sample analyzer 112 in block 304 to determine whether the intensity of the sample exceeds the threshold difference. In implementations, the threshold difference can be a user-defined value, which can differ between differing analytes of interest. If the sample intensity compared to the standard intensity is within the threshold difference (e.g., within a 10% difference), then the sample intensity is determined to be within the desired accuracy and the analysis is completed. If the sample intensity compared to the standard intensity exceeds the threshold difference (e.g., greater than a 10% difference), then the method 300 proceeds to block 314, where the flow rate of the sample is adjusted. For example, the controller 114 can manipulate syringe pump 200 and syringe pump 202 to adjust a flow rate of the sample to the sample analyzer 112 as compared to the previous flow rate that provided the sample intensity that exceeded the threshold difference. For desolvation systems (e.g., system 100) having flow rates up to about 300 microliters per min (300 μL/min), the intensity of a sample and the flow rate of the sample have an approximately linear relationship. Thus, if the intensity of the sample measured by the sample analyzer 112 exceeds the intensity of any of the standard concentrations, the controller 114 can reduce the linear actuation of one or more of syringe pump 200 and syringe pump 202 to reduce the intensity of the sample measured by the sample analyzer 112 according to the linear relationship. Once the flow rate is adjusted, the method 300 proceeds back to block 308 to send the sample to the sample analyzer where the intensity can be measured (block 310) and a new determination of whether the threshold difference can be made (block 312).

Generally, any of the functions described herein can be implemented using software, firmware, hardware (e.g., fixed logic circuitry), manual processing, or a combination of these implementations. The terms "module" and "functionality" as used herein generally represent software, firmware, hardware, or a combination thereof. The communication between modules in the system 100, for example, can be wired, wireless, or some combination thereof. In the case of a software implementation, for instance, a module may represent executable instructions that perform specified tasks when executed on a processor, such as the processor described herein. The program code can be stored in one or more device-readable storage media, an example of which is the memory associated with the computing device.

CONCLUSION

Although the subject matter has been described in language specific to structural features and/or process operations, it is to be understood that the subject matter defined in the appended claims is not necessarily limited to the specific features or acts described above. Rather, the specific features and acts described above are disclosed as example forms of implementing the claims.

What is claimed is:

1. A system comprising:

a syringe pump operably coupled to a desolvation unit, the desolvation unit coupled to an inductively coupled plasma spectrometer sample analyzer configured to measure an intensity of one or more analytes in a sample solution provided through operation of the syringe pump; and a controller operably coupled to the syringe pump, the controller configured to receive the intensity of the one or more analytes in the sample solution measured by the inductively coupled plasma spectrometer sample analyzer, determine whether the intensity of the one or more analytes in the sample solution exceeds a threshold difference of an intensity of at least one standard measured by the inductively coupled plasma spectrometer sample analyzer, and adjust one or more control parameters of the syringe pump when the intensity of the one or more analytes in the sample solution exceeds the threshold difference to control a flow rate of the sample solution introduced to the inductively coupled plasma spectrometer sample analyzer.

2. The system of claim 1, wherein the threshold difference is a difference of ten percent.

3. The system of claim 1, wherein the syringe pump is configured to be coupled with a carrier solution, the carrier solution configured to introduce the sample solution to the inductively coupled plasma spectrometer sample analyzer through operation of the syringe pump.

4. The system of claim 1, wherein the syringe pump includes at least a first syringe pump and a second syringe pump.

5. The system of claim 4, wherein at least one of the first syringe pump or the second syringe pump is configured to be coupled with a carrier solution, the carrier solution configured to introduce the sample solution to the inductively coupled plasma spectrometer sample analyzer through operation of the at least one of the first syringe pump or the second syringe pump.

6. The system of claim 1, wherein the flow rate of the sample solution introduced to the inductively coupled plasma spectrometer sample analyzer is less than 300 microliters per minute.

7. The system of claim 1, wherein the inductively coupled plasma spectrometer sample analyzer includes at least one of an inductively coupled plasma mass spectrometer (ICP/ICP-MS), a multicollector inductively coupled plasma mass spectrometer, or an inductively coupled plasma atomic emission spectrometer (ICP-AES).

8. The system of claim 1, wherein one or more control parameters of the syringe pump include a rate of linear actuation of the syringe pump.

9. A method for automatically adjusting a flow rate of a fluid sample responsive to a detected intensity of the fluid sample, comprising:

transporting a fluid standard to an inductively coupled plasma spectrometer sample analyzer;

measuring an intensity of the fluid standard with the inductively coupled plasma spectrometer sample analyzer;

transporting a fluid sample to the inductively coupled plasma spectrometer sample analyzer through operation of at least one syringe pump;

measuring an intensity of one or more analytes in the fluid sample with the inductively coupled plasma spectrometer sample analyzer;

determining whether the intensity of the one or more analytes in the fluid sample exceeds a threshold difference as compared to the intensity of the fluid standard through operation of a controller;

adjusting a flow rate of the fluid sample to the inductively coupled plasma spectrometer sample analyzer through control of the at least one syringe pump by the controller when the intensity of the one or more analytes in the fluid sample is determined to exceed the threshold difference as compared to the intensity of the fluid standard.

10. The method of claim 9, wherein the threshold difference is a difference of ten percent.

11. The method of claim 9, further comprising:

transporting a second fluid standard to the inductively coupled plasma spectrometer sample analyzer, the second fluid standard having a different concentration than the fluid standard; and measuring an intensity of the second fluid standard with the inductively coupled plasma spectrometer sample analyzer.

12. The method of claim 11, further comprising:

building a standard calibration curve through operation of the controller with at least the intensity of the fluid standard measured by the inductively coupled plasma spectrometer sample analyzer and the intensity of the second fluid standard measured by the inductively coupled plasma spectrometer sample analyzer.

13. The method of claim 9, wherein adjusting a flow rate of the fluid sample to the inductively coupled plasma spectrometer sample analyzer through control of the at least one syringe pump by the controller includes adjusting one or more control parameters of the at least one syringe pump through operation of the controller.

14. The method of claim 9, wherein the one or more control parameters of the at least one syringe pump include a rate of linear actuation of the at least one syringe pump.

15. The method of claim 9, wherein transporting a fluid sample to the inductively coupled plasma spectrometer sample analyzer through operation of at least one syringe pump includes transporting the fluid sample through a desolvation unit to the inductively coupled plasma spectrometer sample analyzer through operation of the at least one syringe pump.

16. The method of claim 9, wherein the at least one syringe pump includes a first syringe pump and a second syringe pump.

17. The method of claim 9, wherein transporting a fluid sample to the inductively coupled plasma spectrometer sample analyzer through operation of at least one syringe pump includes transporting the fluid sample to the inductively coupled plasma spectrometer sample analyzer at a rate of less than 300 microliters per minute through operation of the at least one syringe pump.

* * * * *